US007686740B1

(12) United States Patent
Chang

(10) Patent No.: US 7,686,740 B1
(45) Date of Patent: Mar. 30, 2010

(54) EXERCISE DEVICE FOR THE ARM

(76) Inventor: Winshih Chang, 3 Teed Ct., Katonah, NY (US) 10536-3160

( * ) Notice: Subject to any disclaimer, the term of this patent is extended or adjusted under 35 U.S.C. 154(b) by 19 days.

(21) Appl. No.: 12/005,256

(22) Filed: Dec. 27, 2007

(51) Int. Cl.
*A63B 23/16* (2006.01)

(52) U.S. Cl. ..... 482/50; 482/105; 602/21

(58) Field of Classification Search ..... 482/44–50, 482/105, 139, 148; 473/60, 215, 59, 212–214, 473/422, 424–425, 450, 458, 464, 576, 615; 601/40, 46, 69–74, 79, 80; 602/20, 21, 22, 602/5; D21/684
See application file for complete search history.

(56) References Cited

U.S. PATENT DOCUMENTS 1,513,773 A * 11/1924 Thompson ..... 473/576
1,818,287 A * 8/1931 Wahl ..... 601/79
2,318,864 A * 5/1943 Jackson ..... 602/21
3,033,567 A * 5/1962 Raab ..... 473/60
3,165,315 A * 1/1965 Petrusek ..... 482/81
3,185,476 A * 5/1965 Fechner ..... 473/596
3,413,000 A * 11/1968 Alkonis ..... 473/61
3,528,664 A * 9/1970 Gunn, Jr. ..... 473/213
3,640,273 A * 2/1972 Ray ..... 602/5
4,220,333 A * 9/1980 Mercer ..... 473/60
4,247,097 A * 1/1981 Schwartz ..... 482/105
4,377,282 A 3/1983 Hayes
4,632,391 A * 12/1986 Orak ..... 482/110
4,858,916 A * 8/1989 Beaumont ..... 482/105
4,905,988 A * 3/1990 Mooneyhan ..... 482/50
4,938,477 A * 7/1990 Kuervers ..... 482/105
4,957,442 A * 9/1990 Prater ..... 434/166
5,056,504 A * 10/1991 Mann ..... 601/40
5,058,885 A * 10/1991 Brant ..... 482/48
5,139,472 A 8/1992 Caruthers
5,147,262 A 9/1992 Haymanson
5,271,617 A * 12/1993 Gilford ..... 473/450
D352,753 S * 11/1994 Giannini et al. ..... D21/678
5,413,554 A * 5/1995 Trueman ..... 602/21
5,591,089 A * 1/1997 Huffines ..... 473/215
5,685,809 A 11/1997 Murray
5,713,820 A * 2/1998 Carbone ..... 482/79
5,713,823 A 2/1998 Walendzak et al.
5,976,058 A * 11/1999 Gustafson ..... 482/44
D418,562 S 1/2000 Pravitz et al.
6,093,159 A * 7/2000 Racoosin ..... 601/131

(Continued)

FOREIGN PATENT DOCUMENTS

EP 199102 A2 * 10/1986

*Primary Examiner*—Loan H Thanh
*Assistant Examiner*—Daniel F Roland

(57) ABSTRACT

This patent discloses an exercise device to strengthen and rehabilitate an arm. The exercise device may include a splint, a container, and a ball. The container may include a container shell having a container shell interior surface surrounding a container shell void. The container shell interior surface may form a spherical surface having a container shell interior center. The ball may be positioned within the container shell void and include a ball center where, when the exercise device is moved by the arm, both the container and the ball rotate together with the ball center additionally moving around a circumference that follows a circumference of the container shell interior surface. The container may be attached to the splint so that the container shell interior center may be positioned outside of a hand grab radius of a hand of the arm when the exercise device is attached to the arm.

18 Claims, 7 Drawing Sheets

U.S. PATENT DOCUMENTS 6,312,359 B1 * 11/2001 Brundle ..... 482/46
6,422,975 B1 * 7/2002 Chermak ..... 482/46
6,497,673 B2 * 12/2002 Rogalski ..... 602/20
6,547,703 B1 * 4/2003 Swezey et al. ..... 482/91
6,553,574 B1 * 4/2003 Hall et al. ..... 2/160
6,730,049 B2 * 5/2004 Kalvert ..... 601/5
6,776,742 B2 8/2004 Domenge
2002/0173738 A1 * 11/2002 Rogalski ..... 602/21
2003/0119632 A1 * 6/2003 Archuleta ..... 482/49
2006/0035751 A1 * 2/2006 Blair et al. ..... 482/49

* cited by examiner

EXERCISE DEVICE FOR THE ARM

BACKGROUND

1. Field

The information disclosed in this patent relates to a portable exercise device that may work to strengthen and rehabilitate the arm and in particular the shoulder.

2. Background Information

In human anatomy, the shoulder is that part of the body where the arm attaches to the torso. Articulations between the upper arm bone, the collarbone, the shoulder blade, and the associated muscles, ligaments, and tendons that attach these three bones together make up the shoulder joints. A properly working shoulder is flexible over a wide range of motion required in the arms and hands. However, this tremendous range of motion also makes the shoulder extremely unstable, far more prone to dislocation and injury than other joints.

The shoulder is one of the most commonly injured joints in the body. This is due to the complex arrangement of the surrounding ligaments and tendon muscle groups that are needed for, first, stabilization of the joint, and then, second, for providing a coordinated movement of the shoulder through a three-dimensional space at varying velocities of acceleration and deceleration. Unlike the hip joint, which includes a bone socket for support, the shoulder lacks a bone socket and relies solely on the surrounding muscles, tendons, and ligaments for support and stabilization.

The rotator cuff is an anatomical term given to the group of small muscles and their tendons that act to stabilize the shoulder. Moving the shoulder through space requires the coordinated activation and deactivation of the rotator cuff while permitting the larger power muscle group, such as the deltoid and pectoral muscles, to provide the needed acceleration and torque when engaged in any type of throwing or swinging activity. Sports that place high demands on such coordinated efforts include baseball, football, tennis, volleyball, golf, and racquetball, just to name a few. Essentially any activity that requires the use of the arm needs shoulder stability and control to function. These may be anything from hanging a jacket on the coat rack to playing ping-pong or basketball, or holding onto the rope while water skiing.

Shoulder exercises typically are intended to strengthen the shoulder, thus preventing injury; or to rehabilitate the shoulder after injury or surgery. The most basic equipment for the aid of strengthening of the shoulder is the dumbbell. Free-weights allow front to back, up and down, or side-to-side exercises. The larger power muscles are strengthened while the small stabilizing muscle groups are ignored. Exercise rubber bands or tubes, and cable weight systems function similar to free weights. That is, unidirectional strengthening of muscle groups. By varying the technique of how the tube or the cable is pulled, a person may exercise some specific rotator cuff muscles. However, these exercise movements work on only a few muscle groups at a time in a unidirectional manner without the ability to vary the level of intensity during the workout period.

A more interesting training device, the Bodyblade® (U.S. Pat. No. 5,147,262), does require the coordinated efforts of a few opposing muscle groups during the exercise routine. It also has a benefit of allowing the individual to vary the intensity of the workout while in the midst of doing the workout by varying the speed or magnitude at which one moves the Bodyblade®. However, again, it lacks multidirectional, proprioceptive training of all of the surrounding shoulder muscle groups at the same time. The Bodyblade® moves only in a unidirectional plane, i.e. side to side or up and down.

The Dyna-Flex Pro Gyro Trainer® or the Dyna-Flex Power Ball Gyro Trainer® are hand-held devices that use gyroscopic principle for strengthening primarily of the wrist and forearm. However, these trainers include limitations such as (1) that the resistance cannot be varied much during use as it is preset predominantly by the pull of the cord in the rotor groove, and (2) very little resistance or workout ability can be transferred to the shoulder joint. The Center Force Golf Dyna Max Core Gyro Trainer®, although an excellent device, it again strengthens primarily the wrist and forearm grip strengths. The shoulder muscle groups are not isolated for dedicated strengthening because this device has to be gripped onto tightly by the hand, thus the effect of the exercise is directed to the hand, wrist, and forearm via the gripping force that is required while holding onto this device.

The most expensive and complex piece of machinery that physical therapy and rehabilitation centers posses is the Upper Body Ergometer® (UBE). This essentially is a free-standing machine with two crank peddles that allow the user to peddle through as if "riding the bicycle" with the arms. Variable resistances may be set. Drawbacks of the UBE include its expense, non-portability, and lack of variability for training of different shoulder muscle groups.

As noted above, traditional shoulder exercise devices provide exercises in a unidirectional—side-to-side or up and down—manner. However, the shoulder functions in a complex multidirectional manner through three-dimensional space. Although traditional exercises provide some benefits, they lack an ability to strengthen and educate the shoulder in a multidirectional manner that is needed for the numerous types of demands placed upon the shoulder by an infinite number of types of activities. Thus, there is a need for an improved shoulder exercise device for shoulder strengthening and rehabilitation.

SUMMARY

This patent discloses an exercise device to strengthen and rehabilitate an arm. The exercise device may include a splint, a container, and a ball. The container may include a container shell having a container shell interior surface surrounding a container shell void. The container shell interior surface may form a spherical surface having a container shell interior center. The ball may be positioned within the container shell void and include a ball center where, when the exercise device is moved by the arm, both the container and the ball rotate together with the ball center additionally moving around a circumference that follows a circumference of the container shell interior surface. The container may be attached to the splint so that the container shell interior center may be positioned outside of a hand grab radius of a hand of the arm when the exercise device is attached to the arm.

DETAILED DESCRIPTION

Figure 1:
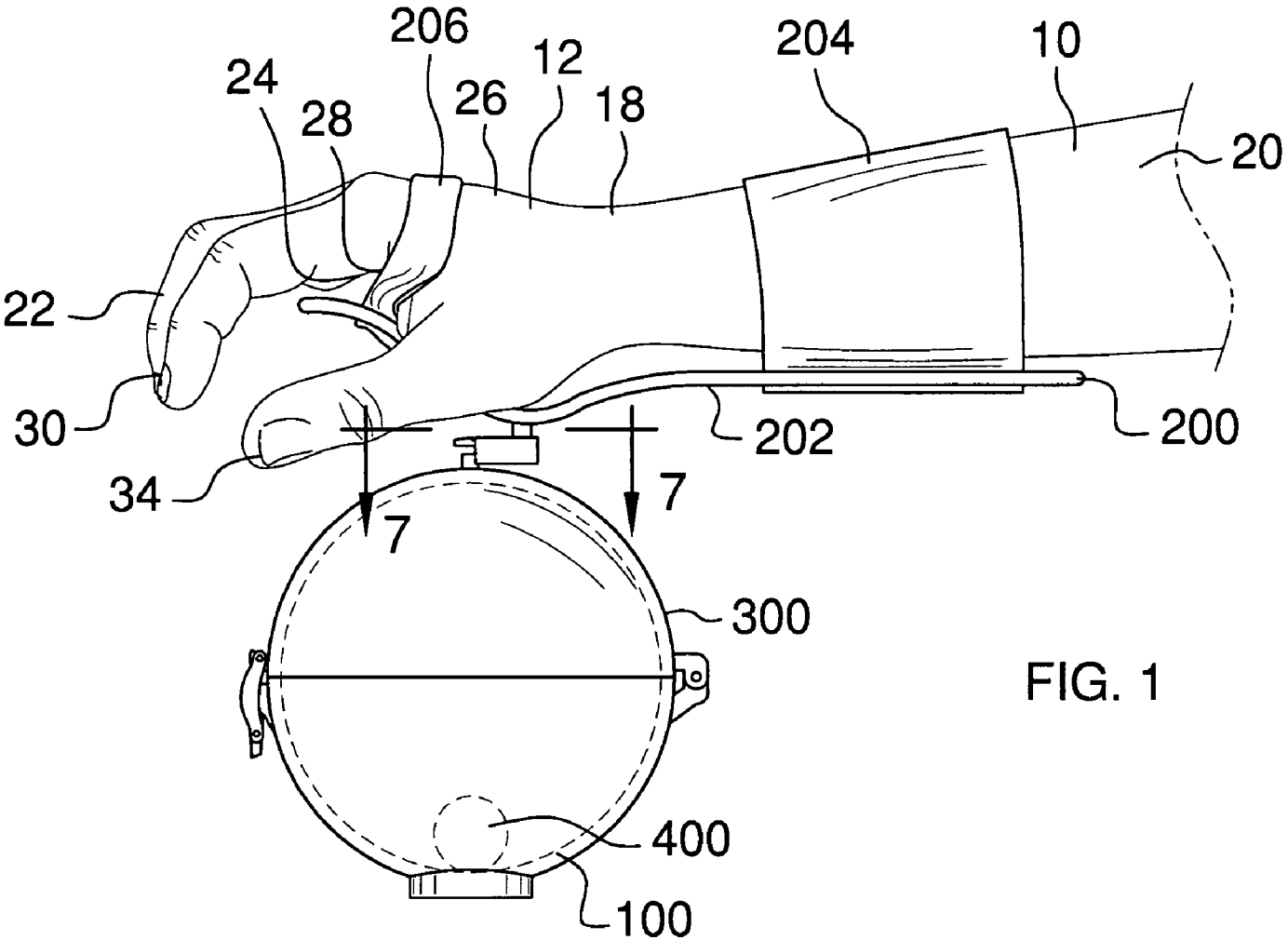
FIG. 1 is a right side view of an exercise device 100 attached to an arm 10.

FIG. 1 is a right side view of an exercise device 100 attached to an arm 10. Exercise device 100 may be a portable exercise device that may work to strengthen and rehabilitate arm 10 and in particular the shoulder of that arm 10. Exercise device 100 may include a splint 200 configured to be attached to arm 10, a container 300 attached to splint 200 at a predetermined location, and a ball 400 positioned within container 300.

In operation, a user may attach exercise device 100 to arm 10 and position a user hand 12 at various positions within three-dimensional space, i.e. in front of his/her body, to his/her side, above his/her head, or in front of the face. The user then may move arm 10 in a circular and multidirectional fashion to cause weighted ball 400 to rotate within container 300 in a centrifugal manner in a bounded area positioned at a predetermined distance from hand 12. The remote centrifugal movement of ball 400 may generate a resistance particular to exercise device 100 that may help exercise the various muscles groups in the person's shoulder, including the small, surrounding stabilizing muscles known as the rotator cuff. By utilizing balls 400 of different weights/diameters and containers 300 of different diameter, an individual may vary the resistance provided by exercise device 100 to provide an effective way to strengthen and rehabilitate the muscles within the shoulder joint and, in turn, help expedite the recovery process after injury or surgery.

Figure 2:
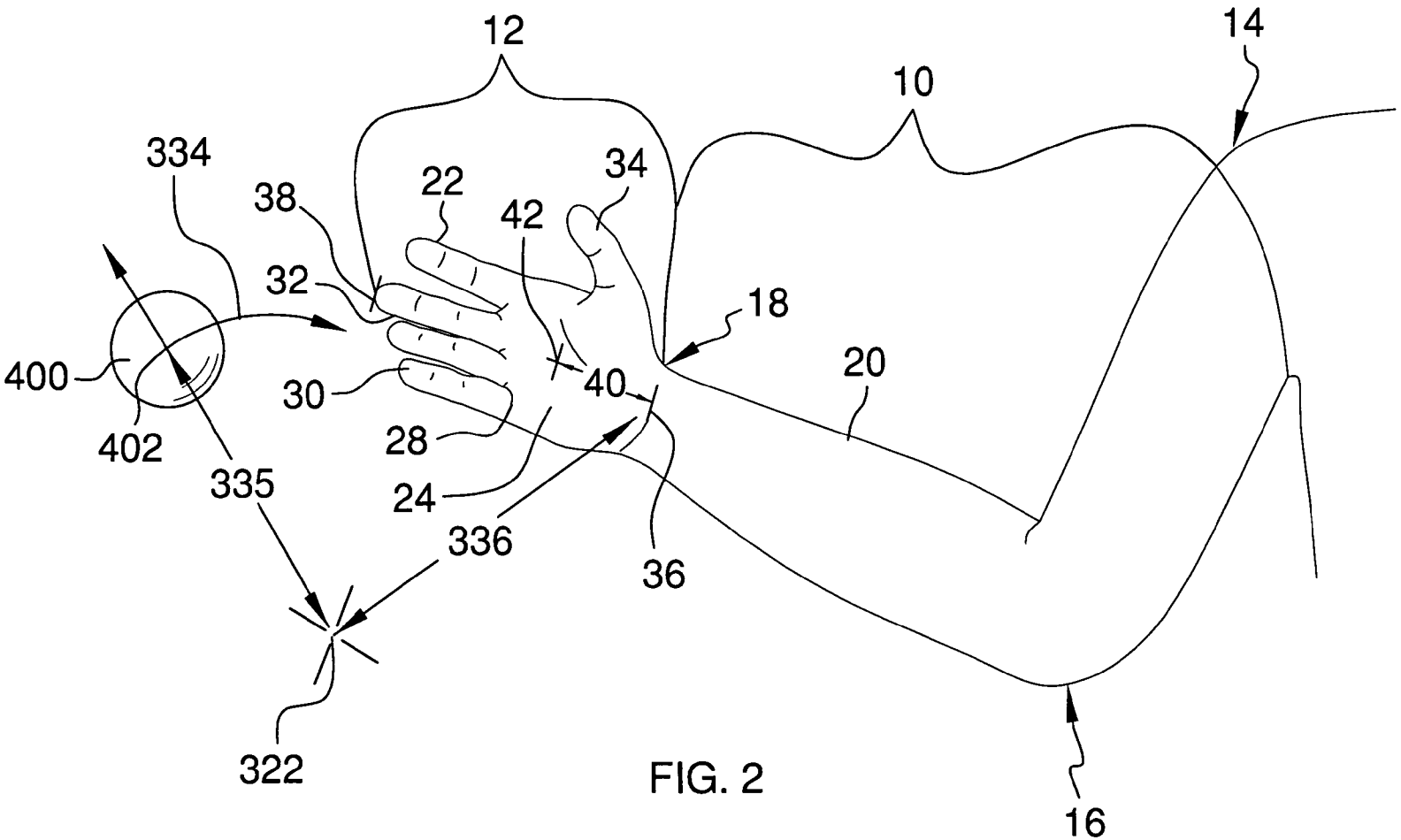
FIG. 2 is a perspective view of arm 10 and hand 12 in relation to movement of ball 400.

Before describing exercise device 100, it may help to have some human anatomy information. FIG. 2 is a perspective view of arm 10 and hand 12 in relation to movement of ball 400. Arm 10 in colloquial speech may refer to the entire upper limb of a person from a shoulder 14 through an elbow 16 to a wrist 18. Wrist 18 may be a flexible and narrower connection between a forearm 20 and hand 12. Forearm 20 may be the structure on the upper limb of the person, between elbow 16 and wrist 18 and hand 12 may be a prehensile body part located at an end of arm 10. Human hand 12 may include digits 22 extending from a palm 24 and a dorsum 26 (FIG. 1). Palm 24 may be an inner surface of hand 12 extending from wrist 18 to a digit base 28 of digits 22 and dorsum 26 may be a back of hand 12 position on hand 12 on a side that is opposite of palm 24. Digits 22 may include fingers 30, including middle finger 32, and a thumb 34 extending from digit base 28.

Proprioception is the sense of the relative position of neighboring parts of the body. Unlike the six exteroceptive senses (sight, taste, smell, touch, hearing, and balance) by which individuals perceive the outside world, and interoceptive senses, by which individuals perceive the pain and the stretching of internal organs, proprioception is a third distinct sensory modality that provides feedback solely on the status of the body internally. It is the sense that indicates whether the body is moving with required effort, as well as where the various parts of the body are located in relation to each other. Exercise device 100 provides proprioceptive training of all of the surrounding shoulder muscle groups at the same time.

Digits 22 of human hand 12 may be extend outward to be position approximately in the same plane as palm 24. The distance from the base of hand 12 at a wrist crease 36 of wrist 18 to a middle finger tip 38 of the middle finger 32 for most adults ranges approximately from 6.3 inches to 8.6 inches. When fingers 30 and thumb 34 are brought together to hold an object such as by making the letter "O", for example, middle finger 32 and thumb 34 may form a grab enclosure having a hand grab radius 40. Hand grab radius 40 may be measured from wrist crease 36 to a palm center 42 and may be measured from palm center 42 to an upper surface of the meeting of middle finger 32 and thumb 34. For most adults, hand grab radius 40 approximately is three to four inches. Since hand 12 need not grip exercise device 100 and a container shell interior center 322 (FIG. 5) of container 300 may be position outside hand grab radius 40 of hand 12, the resistance provided by exercise device 100 is directed away from hand 12, wrist 18, and forearm 20 and is directed towards all of the surrounding muscle groups of shoulder 14. Experiments have shown this works to increase the sense of whether shoulder 14 is moving with the effort needed to control the resistance provided by exercise device 100.

Figure 3:
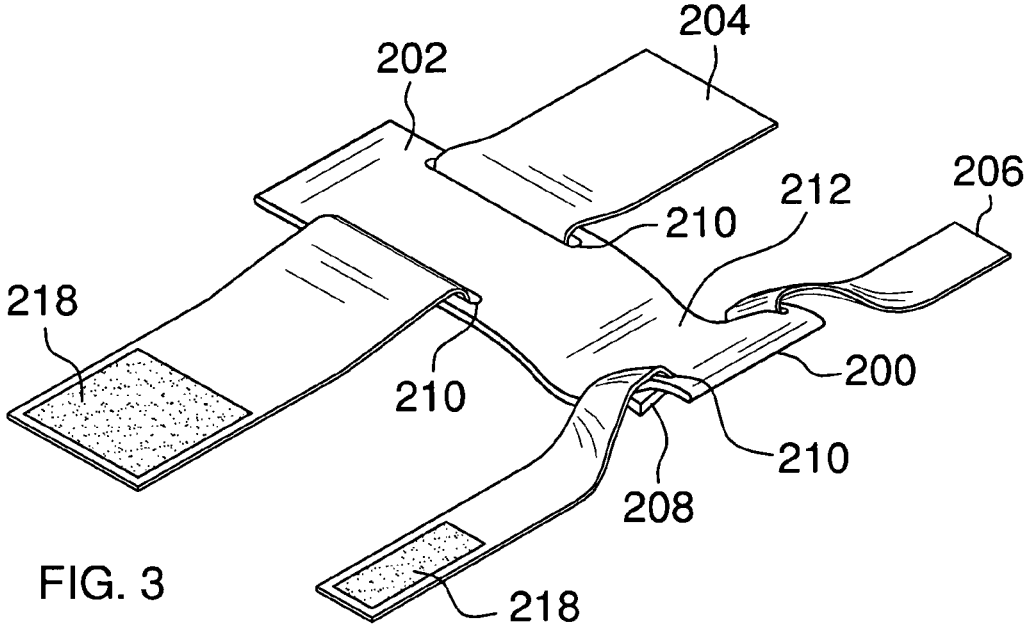
FIG. 3 is a bottom isometric view of splint 200.
Figure 4:
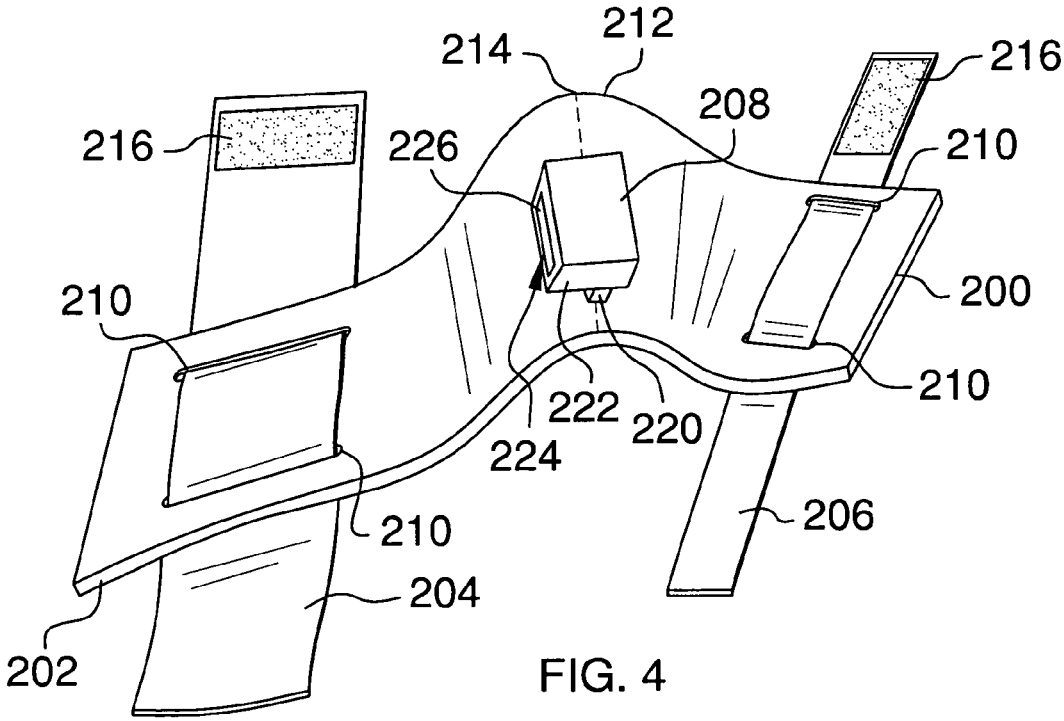
FIG. 4 is a top isometric view of splint 200.

FIG. 3 is a bottom isometric view of splint 200. FIG. 4 is a top isometric view of splint 200. Splint 200 may be a static hand-wrist orthosis to hold wrist 18 at a particular angle and to provide support and proper positioning of hand 12. Splint 200 may include a splint shell 202, a forearm strap 204, a hand strap 206, and buckle body 208. Forearm strap 204 and hand strap 206 may be laced into splint shell 202 and buckle body 208 may be attached to splint shell 202.

Splint shell 202 may be a rigid form that may follow the contour along forearm 20, over wrist 18, and along palm 24. Splint shell 202 may include slots 210 and a shell bump 212 having a shell bump peak 214. Slots 210 may be elongated openings within splint shell 202 that may be configured to receive forearm strap 204 and hand strap 206. Shell bump 212 may be a curvature in a profile of splint shell 202 to permit splint shell 202 to transition from over wrist 18 and along palm 24. Shell bump peak 214 may be a top point of shell bump 212. With splint 200 attached to arm 10, shell bump peak 214 may be configured to align approximately near the area where wrist 18 meets palm 24. Splint shell 202 may be made of lightweight thermoplastic material or of a generally planar malleable metal core covered by a layer of synthetic foam padding material on each of its opposite sides and protected by an outer cover of fabric.

Forearm strap 204 and hand strap 206 each may be an elongated piece of material having ends that may fasten together using hook fasteners 216 and loop fasteners 218. Forearm strap 204 and hand strap 206 each may be laced through slots 210. Hook fasteners 216 and loop fasteners 218 may be brought together to fasten forearm strap 204 around forearm 20 and hand strap 206 around hand 12.

To attach container 300 to splint 200, exercise device 100 may include a buckle body and latch system. Buckle body 208 may be part of the buckle body and latch system. Buckle body 208 may include a buckle body boss 220 and a buckle body housing 222 attached to buckle body boss 220.

Buckle body boss 220 may be a projection fixed to splint 200 along shell bump peak 214 at a midpoint of shell bump peak 214. In one example, screws may removeably fix buckle body boss 220 to splint 200. In another example, rivets may fix buckle body boss 220 to splint 200 to prevent removal of buckle body 208 from splint shell 202.

Figure 5:
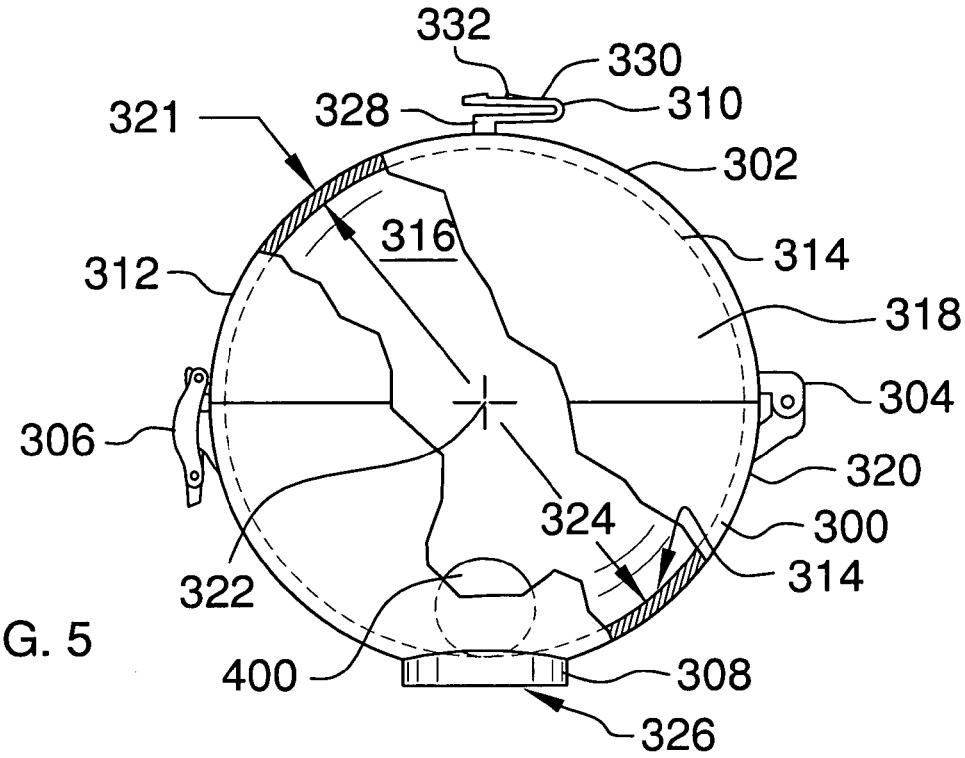
FIG. 5 is a side view of container 300 having container shell interior center 322.

Buckle body housing 222 may be a six sided, rectangular structure configured to receive and retain a buckle latch tongue 330 (FIG. 5). Buckle body housing 222 may have a buckle body housing interior 224, a buckle body housing latch opening 226, and a buckle body housing lock opening 228 (FIG. 7), each of which may lead to buckle body housing interior 224. Buckle body 208 may be attached to splint shell 202 so that buckle body housing latch opening 226 faces hand strap 206 and fingers 30.

Figure 6:
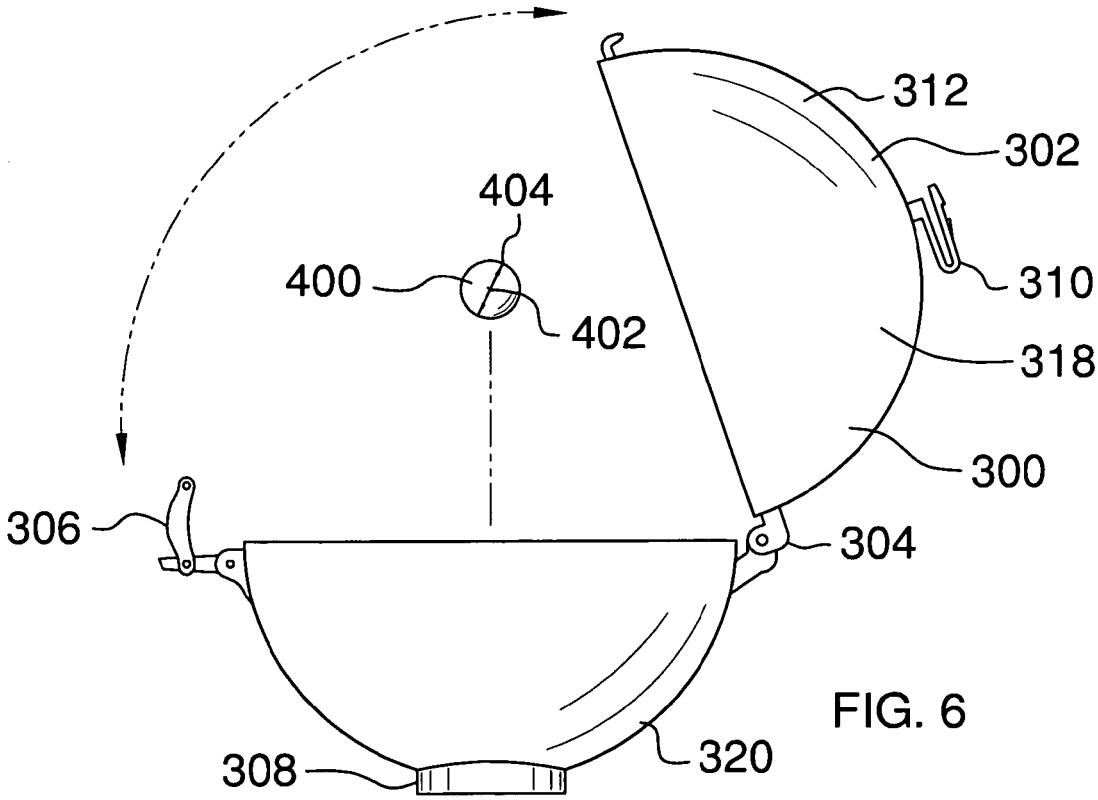
FIG. 6 is a side view of container 300 in a partially open position.

FIG. 5 is a side view of container 300 having container shell interior center 322. FIG. 6 is a side view of container 300 in a partially open position. Container 300 may be an object to encompass ball 400 and to provide rotation paths for ball 400 to roll around inside container 300. When exercise device 100 is moved by arm 10, both container 300 and ball 400 may rotate together clockwise or counterclockwise with ball 400 additionally moving around within container 300.

Container 300 may include a container shell 302, a hinge 304, a lock 306, a stand 308, and a buckle latch 310. Hinge 304, lock 306, stand 308, and buckle latch 310 each may be attached to container shell 302.

Container shell 302 may include a container shell exterior surface 312, a container shell interior surface 314, a container shell void 316, a container shell upper part 318, and a container shell lower part 320.

Container shell exterior surface 312 may be that surface positioned on the outer side of container shell 302 and container shell interior surface 314 may be that surface positioned on the inside of container shell 302. Container shell 302 may have a container shell thickness 321 as measured between container shell exterior surface 312 and container shell interior surface 314. In one example, container shell thickness 321 approximately may be 0.1 inches thick.

Container shell interior surface 314 may form a spherical surface having container shell interior center 322 and a container shell interior diameter 324 passing through container shell interior center 322. Proprioception may be increased by positioning the resistance provided by the movement of ball 400 outside of hand grab radius 40. In one example, container shell interior diameter 324 may be greater than hand grab radius 40. In another example, container shell interior diameter 324 may be one of 8-inch, 6-inch, and 4-inch diameter.

Container shell void 316 may be an empty space surrounded by container shell interior surface 314. Preferably, container shell void 316 may be large enough to permit ball 400 to both rotate and move within container shell void 316. Container shell void 316 may be defined by container shell interior diameter 324.

Container shell upper part 318 and container shell lower part 320 may be two halves of container shell 302 that may come together to enclose container shell interior surface 314. Container shell upper part 318 and container shell lower part 320 each may have a hemisphere shape as half of a sphere.

Hinge 304 may be a jointed or flexible device that may allow container shell upper part 318 to pivot relative to container shell lower part 320. Hinge 304 may attach container shell upper part 318 to container shell lower part 320. In one example, hinge 304 may be two jointed plates moveably fixed to each other by a pin, where each plate may be attached to container shell exterior surface 312.

Lock 306 may be a device that may restrain container shell upper part 318 against container shell lower part 320 to seal container shell void 316 and prevent ball 400 from leaving container shell void 316. Lock 306 may be attached to container shell exterior surface 312. Lock 306 may have a first part attached to container shell upper part 318 and a second part attached to container shell lower part 320 that may be configured to mate with the first part attached to container shell upper part 318. In one example, lock 306 may include a clasp strap and a catchplate configured to be mechanically joined with the clasp strap.

Stand 308 may be a base upon which container 300 may rest upright. Stand 308 may have a flat surface 326 having a diameter large enough to keep container 300 from moving when container 300 is placed upon a flat surface. In one example, stand 308 may be attached to container shell exterior surface 312 at a position that substantially may be equidistance between hinge 304 and lock 306. Stand 308 may be molded to container shell exterior surface 312 as a platform on which to rest container 300.

As noted above, exercise device 100 may include a buckle body and latch system to attach container 300 to splint 200. Buckle latch 310 may be part of the buckle body and latch system along with buckle body 208. Buckle latch 310 may include a buckle latch boss 328 and buckle latch tongue 330 attached to buckle latch boss 328.

Buckle latch boss 328 may be a projection fixed to container shell upper part 318 on container shell exterior surface 312 at a position that substantially may be equidistance between hinge 304 and lock 306. In one example, screws may removeably fix buckle latch boss 328 to container shell 302. In another example, rivets may fix buckle latch boss 328 to container shell 302 to prevent removal of buckle latch 310 from container shell 302. In a further example, buckle latch boss 328 and container shell upper part 318 may be a single piece such as manufactured from an injection molded plastic process.

Figure 7:
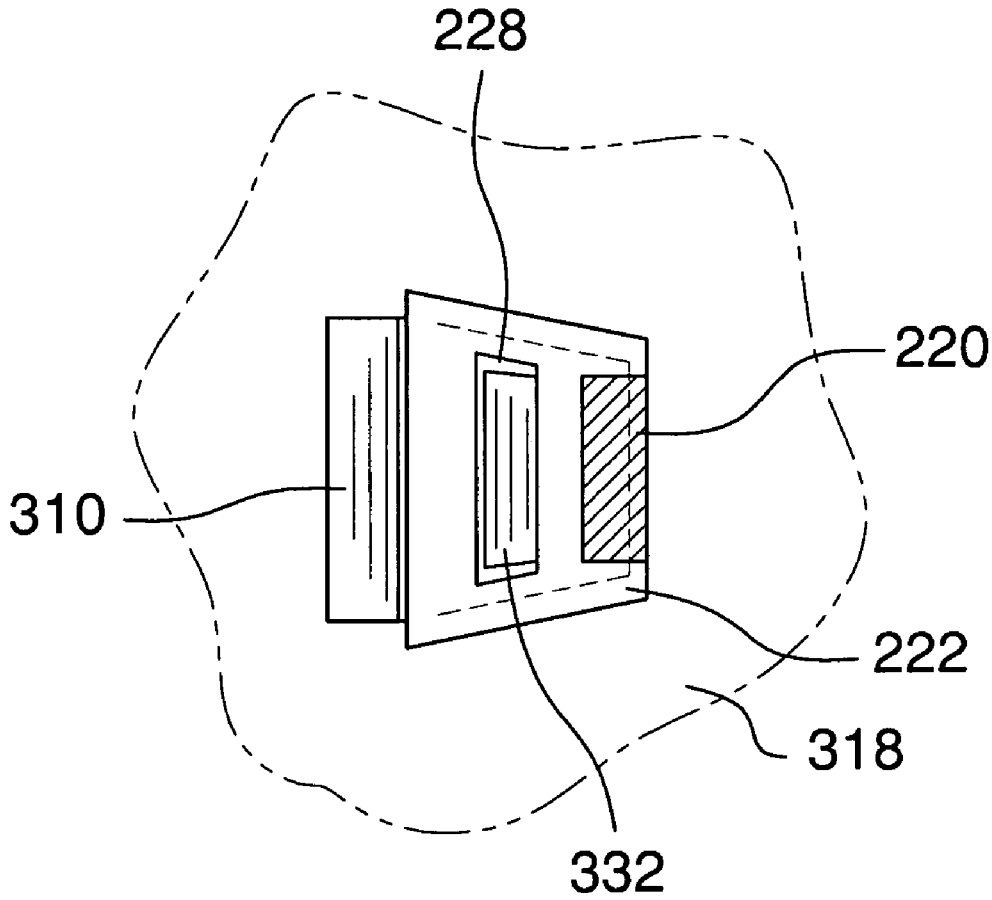
FIG. 7 is a cross section view of container 300 generally taken off line 7-7 of FIG. 1.

FIG. 7 is a cross section view of container 300 generally taken off line 7-7 of FIG. 1. Buckle latch tongue 330 may be a resilient, curved clip having a tongue ridge 332. Buckle latch tongue 330 may be configured to compress on being inserted into buckle body housing interior 224 and return towards an original shape once tongue ridge 332 is aligned with buckle body housing lock opening 228. Tongue ridge 332 may be a projection extending from buckle latch tongue 330 that may be configured to fit within buckle body housing lock opening 228 to aid in retaining buckle latch 310 within buckle body 208.

Ball 400 (FIG. 6) may be a round object with a spherical shape. Ball 400 may be sold and have a ball center 402 and a ball diameter 404. Preferably, ball 400 may be sized so that ball 400 may rotate within container shell void 316 and ball center 402 may move within container shell void 316. In one example, a ratio of container shell interior diameter 324 to ball diameter 404 approximately may be 10:1. Preferably, ball 400 has a weight of one of 12, 9, 6, and 3 ounces.

Ball 400 may be a round object whose center may move in relation to the circumference of container shell interior surface 314. For example, when exercise device 100 is moved by arm 10, both container 300 and ball 400 may rotate together clockwise or counterclockwise with ball center 402 moving around a ball center circumference 334 (FIG. 2) that follows a circumference of container shell interior surface 314. Ball center circumference 334 may have a ball center circumference 335 as measured between container shell interior center 322 and ball center 402.

Figure 8:
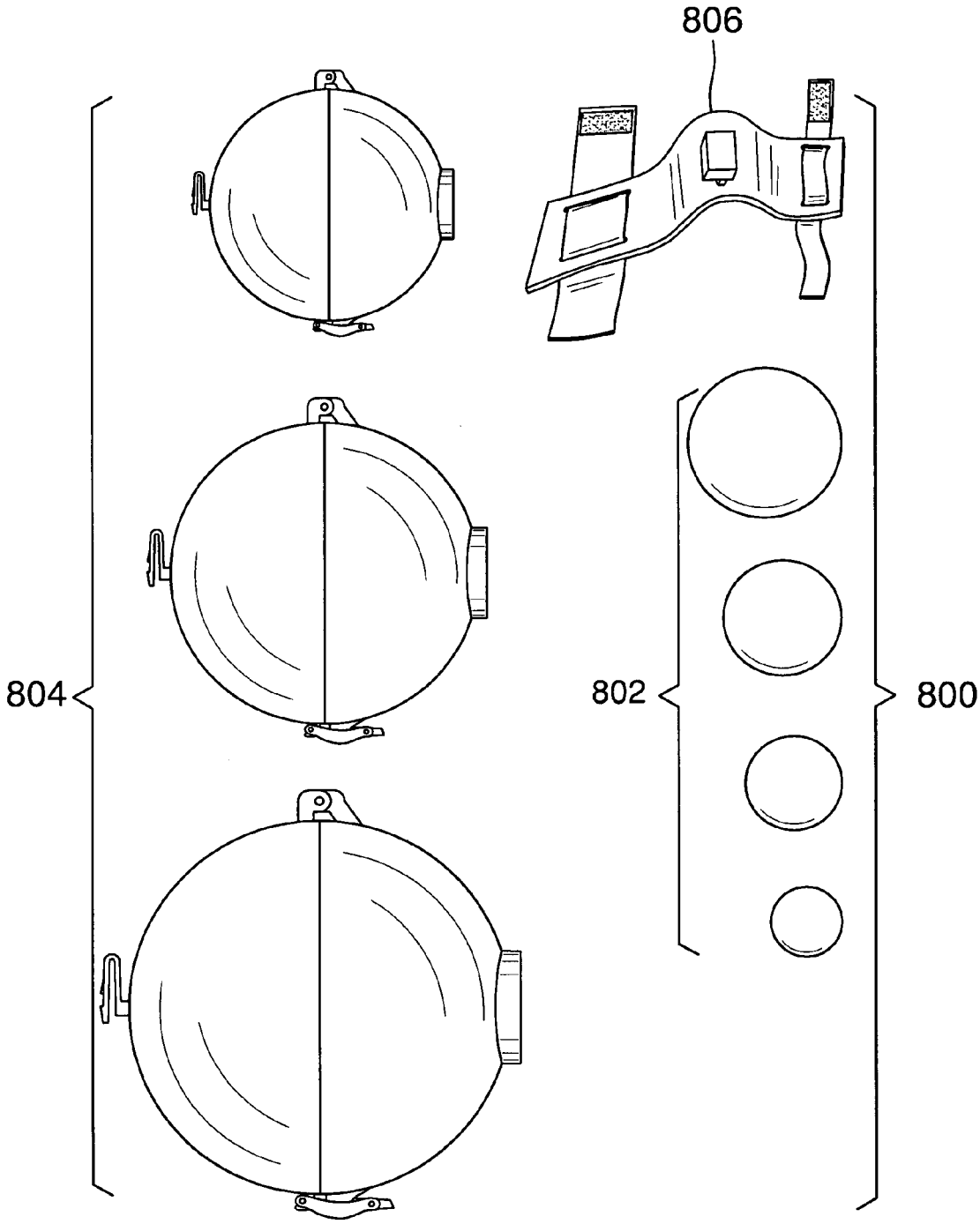
FIG. 8 is an exercise device kit 800.

FIG. 8 is an exercise device kit 800. Exercise device kit 800 may include balls 802 and containers 804, and a splint 806. Balls 802 may include four balls in four different weights including 12, 9, 6, and 3 ounces. Containers 804 may include three containers in three different container shell interior diameters of 8-inches, 6-inches, and 4-inches. Twelve degrees of resistance may be possible with four balls 802 and three containers 804.

When splint 200 is attached to arm 10 and container 300 is attached to splint 200, container shell interior center 322 may be offset from the center of palm 24. In other words, a line 336 (FIG. 2) passing from container shell interior center 322 through buckle body boss 220 approximately may pass through wrist 18. Proprioception may be increased by aligning line 336 offset from palm center 42.

Figure 9:
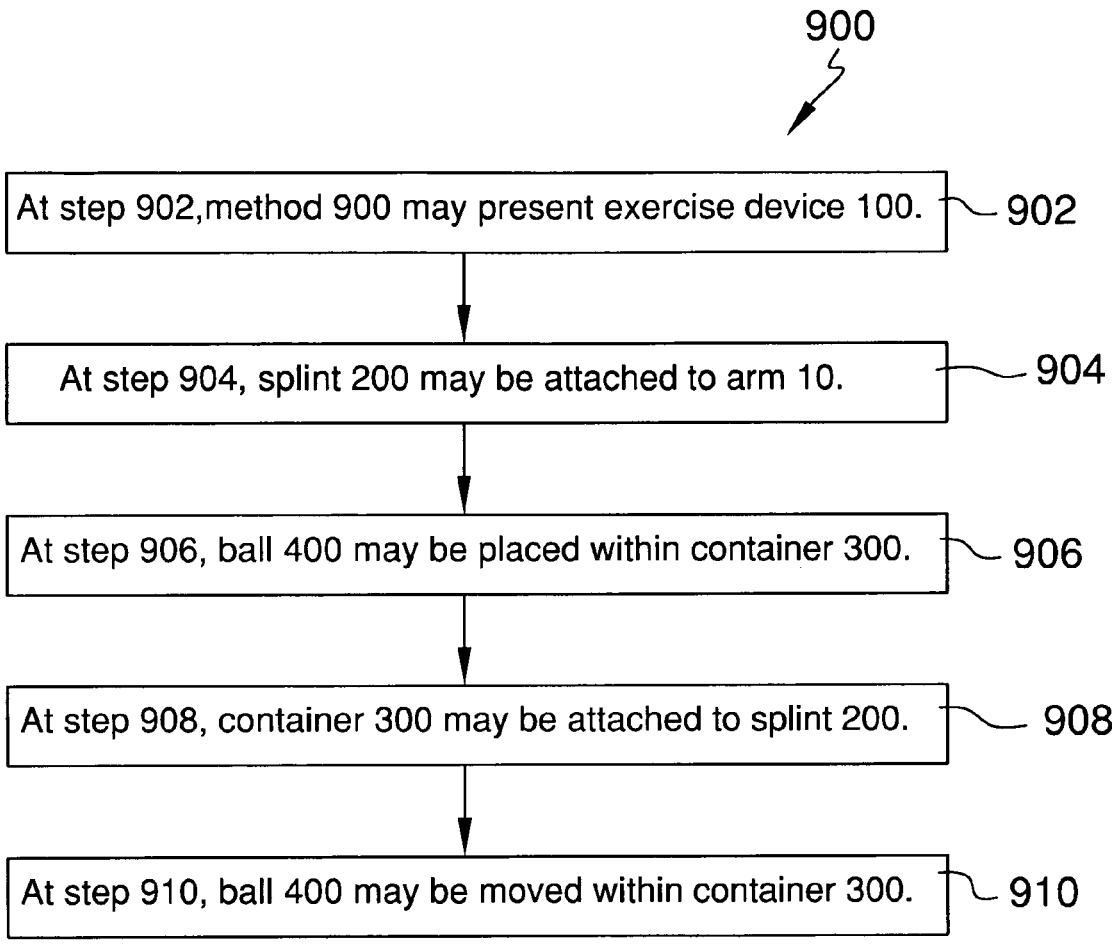
FIG. 9 is a method 900 to strengthen and rehabilitate arm 10 and in particular the shoulder of that arm 10.

FIG. 9 is a method 900 to strengthen and rehabilitate arm 10 and in particular the shoulder of that arm 10. At step 902, method 900 may present exercise device 100. At step 904, splint 200 may be attached to arm 10. At step 906, ball 400 may be placed within container 300. At step 908, container 300 may be attached to splint 200. At step 910, ball 400 may be moved within container 300.

The exercise device may be an accessory for individuals who are recovering from shoulder injuries or surgeries. The exercise device may provide an effective way to rehabilitate and strengthen the muscles in the rotator cuff, as it may allow an individual to experience resistance using omni-directional movements with the arm. Such a device may be particularly ideal for use among athletes, personal trainers, and physical therapists.

The exercise device may include a slim plastic wrist splint that may measure approximately eight inches long and two inches wide. The splint may include two nylon hook and loop straps that may allow the splint to be secured to the underside of an individual's forearm and his/her palm. The distal or far end of the splint may curve upward to accommodate the curve of the hand and palm. The splint also may include a trapezoidal fastener that may allow for the attachment of one of three containers that may be included with the exercise device.

Each container of the exercise device may be produced from plastic and may be constructed in two mating hemispheres, each of which may feature clip- or clasp-style closures that may keep the halves secured and locked during use. The top half of the each container may include a handle-like device that may mate with the trapezoidal fastener on the underside of the wrist splint. The mating components on the container and the splint may fit snugly and may ensure the container did not detach from the splint during use. The containers may have one of 8-inch, 6-inch, and 4-inch diameters.

Also included with the exercise device may be a series of steel ball bearings. These bearings have different weights, including 12, 9, 6, and 3 ounces. An individual may select one of the ball bearings for placement within one of the containers. The choice between three containers and the four ball bearings provides the potential for twelve different resistance experiences.

To use the exercise device an individual may simply select the desired container and place the desired ball bearing within the component. Once the halves of the container are joined, the container may be affixed to the underside of the wrist splint and the splint secured to the user's arm via the nylon hook and loop straps. Alternatively, the container may be fixed to the wrist splint permanently rather than be detachable/interchangeable components.

Since the container is secured to the splint, the user need not hold the container within his/her hand and the need to grasp any portion of the exercise device may be eliminated. This frees the arm from having to control the hand muscles and allows the exercise to direct more resistance into the shoulder.

With the exercise device attached to the person's arm, the user may position his/her hand at various heights and positions within three-dimensional space, i.e. in front of his/her body, to his/her side, above his/her head, or in front of the face. The user then may move his/her arm in a circular and multidirectional fashion to spin the ball bearing within the container in a centrifugal manner. This may generate gyroscopic-like resistance. This resistance may help exercise the various muscles groups in the shoulder, specifically small, surrounding stabilizing muscles known as the rotator cuff. An individual may vary the resistance of the device by using different combinations of containers and ball bearings. This may provide an effective way to strengthen and rehabilitate the muscles within the shoulder joint and may thus help expedite the recovery process after injury or surgery.

The exercise device may fulfill the need for a way to safely rehabilitate and strengthen the muscles in the shoulder joint. The appealing features of the exercise device may be its ease of use, safe and effectiveness, versatility, small size and compactness, portability, and ability to help rehabilitate the shoulder after surgery or injury.

The exercise device may provide a safe and easy way to strengthen and rehabilitate the muscles in the shoulder, specifically the stabilizing muscles in the rotator cuff. It also may be used to strengthen, tone, and rehabilitate the deltoid and pectoral muscles to a degree. This device may provide resistance in a gyroscopic manner when an individual rotated his/her arm from the shoulder in an omni-directional manner. Thus, the exercise device may provide a more effective way to rehabilitate and strengthen the muscles in the rotator cuff. Using the device consistently may lead to a quicker recovery from injury or surgery and a reduced risk of re-injuring the shoulder joint.

In addition, the user's movements may generate the gyroscopic resistance offered by the exercise device. Thus, the individual may vary the degree of intensity during a workout or rehabilitation exercise. The user also may employ combinations of containers and ball bearings to achieve as many as twelve degrees of resistance. This may allow an individual to use a minimal amount of resistance when beginning a rehabilitation regimen for the shoulder and then increase resistance gradually as the muscles in the rotator cuff became stronger. This may allow the individual to make steady and consistent progress when recovering from an injury or surgery and may reduce the risk of re-injuring the shoulder during a rehabilitation program.

The exercise device may feature a small, lightweight, and compact design and thus may be transported to any location and used virtually anywhere. It may, be ideal for use in the home, as well as in rehabilitation clinics, sports medicine facilities, and hospitals. The portable nature of the exercise device may make it ideal for use among physical therapists and personal trainers, as it may be easily transported to clients' homes for use during private training and rehabilitation sessions. The exercise device also may be particularly ideal for use among a wide range of athletes, particularly those who place significant amounts of stress on their shoulders. These may include both professional and recreational athletes who play baseball, football, tennis, volleyball, golf, hockey, and basketball. The exercise device may be safe and easy to use, effectively designed, versatile, convenient, practical, and durable for years of virtually maintenance-free use.

The exercise device may work on all the shoulder muscle groups at the same time in a multidirectional manner with the ability to vary the level of intensity during the workout period. The resistance may be varied during use by utilizing containers with different diameters and balls with different weights. In addition to providing variability for training of different shoulder muscle groups, most of the resistance or workout ability may be transferred to the shoulder joint. The shoulder muscle groups may be isolated for dedicated strengthening because the hand need not grip onto this device.

The exercise device may be a portable exercise device for strengthening the shoulder. A splint may be strapped to the wrist while the "palm" side of the splint may be affixed to interchangeable spherical containers of different sizes. Each container may be opened to receive one or more steel ball bearings of different weights. The various sizes of the containers along with the different combinations of the steel ball bearings placed give rise to a large selection of variable resistances available for training. The container may be moved in a circular fashion while attached to the wrist splint. The difficulty or level of resistance of exercise may be determined by varying the speed and, or, the magnitude at which the container may be moved. Additionally, the specific muscle group to be trained can also be determined by varying the position in space of the container while it may be being "gyrated"

The exercise device may include three separate components: (1) a wrist splint, (2) a container, and (3) small steel ball bearings. The wrist splint may obviate a need of the individual having to grip onto the device while doing the workout. The splint stabilizes the wrist joint and one may exercise without the need of having to grip onto the device, thus isolating the shoulder muscles for a dedicated shoulder workout.

The wrist splint may include two hook and loop fastener straps that may circumferentially strap onto the forearm for stability. The distal end of the splint under the palm may be trapezoidal in shape to allow "slip-on" attachment of the container. On top of the container may be an assembled handle-like device that also may be trapezoidal in shape to allow mating with the wrist splint for slipping on and off. The design of the trapezoidal shape allows only a predetermined, fixed distance of slip on. In addition, after it has maximized its travel distance, the fit may be quite secure and tight. This may prevent accidental dropping of the container during the workout.

The container may be opened up to form two hemispheres. These two hemispheres when closed may be locked together securely by a clip on each side of the hemisphere. The steel ball bearings may be placed within the container when the container is open. Alternatively, the container may be a solid sphere having a ball permanently positioned within the container. After a user closes the container and securely affixes the container to the wrist splint, the user may moves his/her arm in a circular fashion to self-create or generate a gyroscopic effect via the centrifugal movement of the steel ball bearing within the container. The individual may vary the intensity of the level of workout by varying the speed at which one moves the container or by varying the magnitude of movement of the arm.

In the process of generating the gyroscopic effect, the shoulder may be stressed in a multidirectional manner. Opposing muscle groups surrounding the shoulder joint must activate and deactivate in a synchronous rapid fashion in response to the resistance provided by the exercise device. This develops the strength and coordination of small stabilizing rotator cuff muscle groups at small magnitudes of movement, while the larger power muscles will be called into action at larger magnitudes of movement. By placing the hand in various positions during the workout, such as changing from the front of the body to the side of the body, the user may target train different muscle groups specifically at different times during the same workout period. This improves proprioception and ability to move the shoulder in a coordinated three-dimensional fashion that may be the basis of all activities of the shoulder during daily use.

The level of difficulty of workout also may be varied by selecting different combinations of the container and steel ball-bearing mix. Combining as a kit three containers of three different diameters: 8 inches, 6 inches, and 4 inches with steel ball bearing of four different weights: 12 ozs, 9 ozs, 6 ozs, and 3 ozs give rise to twelve combinations of levels of difficulty. The larger the container, the heavier the steel ball bearing, the higher the degree of difficulty.

The present invention provides a portable exercise device that may be specifically dedicated for strengthening of the shoulder joint. The exercise device may provide multidirectional exercise capability that strengthens all of the surrounding shoulder muscles at the same time in a functional manner. The exercise device may improve coordination and proprioception of the shoulder stabilizers while strengthens the power muscle groups. The centrifugal and gyroscopic resistance provided by the exercise device may be self-generated by the user and the level of intensity may be varied at any time during its use. Thus, a user may train either the small shoulder stabilizing muscle groups or the power accelerators by varying the magnitude of movement of the container.

The exercise device may present a large selection of varying levels of difficulty of workout using interchangeable container sizes and placement of interchangeable steel ball bearings of different weights within the container. The exercise device may be light in weight, but the centrifugal and gyroscopic principles employed by the exercise device may generate up to 100 pounds of torque energy, such as seen in high velocity throwing or swinging sports. The exercise device may benefit training camps for high-level overhead athletes. The small size of the exercise device makes it easy to transport and may be used while traveling on business or used by a personal trainer when visiting different client households.

In order to spin or gyrate the ball bearing within the container, a user needs to exert a certain amount of force in a well-coordinated fashion with rapid activation and de-activation of the surrounding rotator cuff mechanism. By selecting different combinations of ball-bearing weights and size of the containers, the user may adjust the level of workout that one may be able to accomplish. Thus, the level of workout provided by the biofeedback mechanism of the exercise device may be similar to that experienced in playing tennis.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. An exercise device to strengthen and rehabilitate the shoulder of an arm of a person utilizing the exercise device, the exercise device comprising:

a splint, where the splint is a static hand-wrist orthosis and includes a splint shell configured to be attached to an arm to restrain a wrist between the arm and a hand from moving in a turning motion, a forearm strap attached to the splint shell, and a hand strap attached to the splint shell, where the splint shell has a shell bump having a shell bump peak and has a splint palm side located on a side opposite that of the shell bump peak and located adjacent to both the shell bump and the hand strap, where the splint palm side is configured to contact a palm of a hand;

a container having a container shell, where the container shell includes a container shell interior surface surrounding a container shell void, where the container shell interior surface forms a spherical surface having a container shell interior center and a container shell interior diameter passing through the container shell interior center; and where a container shell exterior surface forms a spherical surface; and a ball positioned within the container shell void and having a ball center and a ball diameter, where, when the exercise device is moved by the arm, both the container and the ball rotate together with the ball center additionally moving around a circumference that follows a circumference of the container shell interior surface, where the container is rigidly attached to the splint so that the container shell interior center is so positioned and fixed in place relative to the splint palm side as to be outside of a four inch hand grab radius of a hand of the arm wherein the exercise device is attachable to an arm so that the splint palm side is adjacent to a palm of a hand, and where the container is configured to be positioned perpendicularly remote from a palm and be positioned below a wrist when the exercise device is attached to an arm, and where moving and rotating the entire arm works to move and rotate the container and to move and rotate the ball within and relative to the container to strengthen and rehabilitate the shoulder of the arm.

2. The exercise device of claim 1, where the container is attached to the splint at the shell bump peak.

3. The exercise device of claim 1, where the container shell interior diameter is greater than a hand grab radius of a hand of the 95th percentile adult male.

4. The exercise device of claim 1, where a ratio of the container shell interior diameter to the ball diameter approximately is 10:1.

5. The exercise device of claim 1, where the splint is configured to be attached to arm to hold a wrist of the arm at a particular angle and to provide support and positioning of a hand of the arm, where the splint further includes a buckle body attached to the shell bump peak, and where the container shell includes a buckle latch removeably connected to the buckle body.

6. The exercise device of claim 5, where the container shell includes a container shell upper part and a container shell lower part, a hinge attached between the container shell upper part and the container shell lower part, and a lock configured to secure the container shell upper part to the container shell lower part.

7. The exercise device of claim 6, where a stand is attached to the container shell lower part.

8. The exercise device of claim 6, where the container shell upper part and the container shell lower part are two substantially equal halves of the container shell that are configured to come together to enclose the container shell interior surface.

9. The exercise device of claim 6, where the lock includes a clasp strap and a catchplate configured to be mechanically joined with the clasp strap, and where a stand is attached to the container shell exterior surface at a position that substantially is equidistance between the hinge and the lock.

10. The exercise device of claim 6, where the buckle latch includes a buckle latch boss attached to the container shell and includes a buckle latch tongue attached to buckle latch boss, and where the buckle latch tongue is configured to be removeably secured in the buckle body.

11. The exercise device of claim 10, where the buckle latch boss is a projection fixed to the container shell at a position that substantially is equidistance between the hinge and the lock.

12. The exercise device of claim 5, where the buckle body includes a buckle body housing attached to a buckle body boss, where the buckle body boss is attached to the shell bump peak and the buckle body housing has a buckle body housing interior, a buckle body housing latch opening that leads to the buckle body housing interior, and a buckle body housing lock opening that leads to the buckle body housing interior, where the hand strap is configured to fit about the hand, and where the buckle body is attached to the splint shell so that the buckle body housing latch opening faces the hand strap.

13. The exercise device of claim 12, where the ball has a weight approximately of one of 12, 9, 6, and 3 ounces.

14. The exercise device of claim 13, where the container shell interior diameter is one of 8-inches, 6-inches, and 4-inches.

15. An exercise device kit to strengthen and rehabilitate an arm of a person utilizing the exercise device, the exercise device kit comprising:

a splint, where the splint is a static hand-wrist orthosis and includes a splint shell configured to be attached to an arm to restrain a wrist between the arm and a hand from moving in a turning motion, a forearm strap attached to the splint shell, and a hand strap attached to the splint shell, where the splint shell has a shell bump having a shell bump peak and has a splint palm side located on a side opposite that of the shell bump peak and located adjacent to both the shell bump and the hand strap, where the splint palm side is configured to contact a palm of a hand;

at least two containers, where each container includes a container shell, where the container shell includes a container shell interior surface surrounding a container shell void, where the container shell interior surface forms a spherical surface having a container shell interior center and a container shell interior diameter passing through the container shell interior center, where each container shell interior diameter is different; and where a container shell exterior surface forms a spherical surface; and at least two balls where each ball has a different weight, where one ball is positioned within one container shell void and includes a ball center and a ball diameter, where, when the exercise device is moved by the arm, both the container and the ball rotate together with the ball center additionally moving around a circumference that follows a circumference of the container shell interior surface, where the container having the ball positioned within the container shell void is rigidly attached to the splint so that the container shell interior center is so positioned and fixed in place relative to the splint palm side as to be outside of a four inch hand grab radius of a hand of the arm wherein the exercise device is attachable to an arm so that the splint palm side is adjacent to a palm of a hand, and where moving and rotating the entire arm works to move and rotate the container and to move and rotate the ball within and relative to the container to strengthen and rehabilitate the shoulder of the arm.

16. The exercise device kit of claim 15, where the container attached to the splint is attached to the splint at the shell bump peak, and where the container shell includes a container shell upper part and a container shell lower part, a hinge attached between the container shell upper part and the container shell lower part, and a lock configured to secure the container shell upper part to the container shell lower part.

17. A method to strengthen and rehabilitate the shoulder of an arm of a person utilizing the exercise device, the method comprising:

presenting an exercise device having a splint, a container, and a ball, where the splint is a static hand-wrist orthosis and includes a splint shell configured to be attached to an arm to restrain a wrist between the arm and a hand from moving in a turning motion, a forearm strap attached to the splint shell, and a hand strap attached to the splint shell, where the splint shell has a shell bump having a shell bump peak and has a splint palm side located on a side opposite that of the shell bump peak and located adjacent to both the shell bump and the hand strap, where the splint palm side is configured to contact a palm of a hand, where the container includes a container shell, where the container shell includes a container shell interior surface surrounding a container shell void, where the container shell interior surface forms a spherical surface having a container shell interior center and a container shell interior diameter passing through the container shell interior center, and where a container shell exterior surface forms a spherical surface where the ball is positioned within the container shell void and having a ball center and a ball diameter, where, when the exercise device is moved by the arm, both the container and the ball rotate together with the ball center additionally moving around a circumference that follows a circumference of the container shell interior surface, where the container is rigidly attached to the splint so that the container shell interior center is so positioned and fixed in place relative to the splint palm side as to be outside of a four inch hand grab radius of a hand of the arm wherein the exercise device is attachable to an arm so that the splint palm side is adjacent to a palm of a hand to focus the operation of the exercise device away from the hand and fingers of the hand;

attaching the exercise device to the arm by wrapping the forearm strap around a forearm of the arm and wrapping the hand strap around the hand; and moving and rotating the entire arm to move and rotate the container and to move and rotate the ball within and relative to the container to strengthen and rehabilitate the shoulder of the arm.

18. The method of claim 17, where the container is attached to the splint at the shell bump peak, and where the container shell includes a container shell upper part and a container shell lower part, a hinge attached between the container shell upper part and the container shell lower part, and a lock configured to secure the container shell upper part to the container shell lower part.

* * * * *